US006634067B2

(12) United States Patent
Jacobson

(10) Patent No.: US 6,634,067 B2
(45) Date of Patent: Oct. 21, 2003

(54) CONNECTOR FOR A JEWELRY FLEXIBLE MEMBER

(76) Inventor: Donald A. Jacobson, 9719 Brighton La., Eden Prairie, MN (US) 55347

( * ) Notice: Subject to any disclaimer, the term of this patent is extended or adjusted under 35 U.S.C. 154(b) by 0 days.

(21) Appl. No.: 09/961,035

(22) Filed: Sep. 21, 2001

(65) Prior Publication Data

US 2003/0056345 A1 Mar. 27, 2003

(51) Int. Cl.[7] ..... A44B 17/00
(52) U.S. Cl. ..... 24/618; 24/116 A; 24/669
(58) Field of Search ..... 24/116 A, 586.11, 24/587.11, 618, 619, 662, 669, 702

(56) References Cited

U.S. PATENT DOCUMENTS

| | | | | |
|---|---|---|---|---|
| 300,509 | A | * | 6/1884 | Richardson |
| 1,082,140 | A | | 12/1913 | Schonemann et al. |
| 1,270,769 | A | | 7/1918 | Balch |
| 1,406,179 | A | * | 2/1922 | Ford |
| 1,409,034 | A | * | 3/1922 | Smith |
| 1,458,559 | A | * | 6/1923 | Sweet |
| 1,574,961 | A | * | 3/1926 | Fischer |
| 1,721,356 | A | | 7/1929 | Schulz |
| 2,681,545 | A | * | 6/1954 | Hall |
| 3,052,005 | A | * | 9/1962 | Wilson et al. |
| 3,376,616 | A | * | 4/1968 | Kaczorowski |
| 3,830,080 | A | * | 8/1974 | Friedlander |
| 4,001,923 | A | | 1/1977 | Frankel et al. ..... 24/230 SL |
| 4,074,400 | A | * | 2/1978 | Sekiguchi |
| 4,161,806 | A | * | 7/1979 | Hennisse et al. |
| 4,286,360 | A | | 9/1981 | Skobel ..... 24/230 R |
| 4,527,315 | A | | 7/1985 | Sweet et al. ..... 24/615 |
| 4,648,161 | A | * | 3/1987 | Rosen |
| 5,018,250 | A | * | 5/1991 | Schroder |
| 5,245,732 | A | * | 9/1993 | Johnston |
| 5,628,095 | A | | 5/1997 | Appel et al. ..... 24/575 |
| 5,642,558 | A | * | 7/1997 | Bodkin, Sr. |
| 5,653,009 | A | | 8/1997 | Kassardjian ..... 24/667 |
| 5,806,346 | A | * | 9/1998 | Schlinger et al. |

FOREIGN PATENT DOCUMENTS

EP 1133936 A1 * 9/2001

* cited by examiner

*Primary Examiner*—James R. Brittain

(57) ABSTRACT

Apparatus using two parts to connect the ends of a flexible member for attaching jewelry to the person. The connected ends of flexible members under tension always extend outward directly opposite to each other, and always have the same predetermined orientation with respect to their connector. The connection of the two parts of this apparatus can only be made or broken by a force between the parts which is essentially perpendicular to the orientation of the flexible member ends under tension, where one direction of the force connects the parts, and the opposite direction of the force disconnects the parts.

9 Claims, 4 Drawing Sheets

CONNECTOR FOR A JEWELRY FLEXIBLE MEMBER

BACKGROUND OF THE INVENTION

1. Field of the Invention

This invention provides a connector for a flexible member, such as a chain or strand, used to attach jewelry to the person.

2. Description of the Related Art

There are a large number of different types of connectors which have been developed in response to the needs of this application. These include snaps, threaded connectors, interlocking connectors, gripping connectors and various combinations of these arrangements. Some of these connectors are quite complicated and all of them have at least one moving part.

It would be desirable if the connection apparatus could be simplified and not require any complicated or moving parts. In all of these connectors one part must be held in one hand while the other part is held in the other hand to make or break a connection, typically by threading one element through or into another. Because of their small size, attaching these connectors is quite difficult. It would also be desirable if the process to connect or disconnect the parts was made easier, and if the connection process could include a means for aligning the parts to be connected. Using any of the present connectors is particularly difficult when they are used to attach a bracelet because it is impossible to use two hands to connect or disconnect a bracelet around ones own wrist. It would be particularly desirable therefore if the connection and disconnection process for a connector used with a bracelet could be accomplished using only the free hand.

SUMMARY OF THE INVENTION

The primary advantages of the connector are: it has only two simple parts, it is connected and disconnected only by forcing the parts together or apart by a predetermined force acting against a predetermined resistance, it obtains the predetermined resistance merely by flexion or compression of a part, it has guide means for aligning the parts to be connected, and in one embodiment it can be connected and disconnected using only one hand.

I have observed that the connected ends of flexible members under tension always extend outward directly opposite to each other, and always have the same predetermined orientation with respect to their connector. The orientation of the ends of the flexible member under tension relative to the connector is determined by the location of the attachment point of the flexible member ends to the connector. The present invention utilizes that observation. The essence of this invention is that the connection can be made or broken only by a force which is perpendicular to the predetermined orientation of the flexible member ends under tension. Opposed tension forces, regardless of their magnitude, cannot separate the connector parts with this arrangement, because any forces applied by the flexible member ends will always be perpendicular to the force required for disconnection.

With this arrangement the connector must be made strong enough to withstand any tension forces applied by the opposed ends of a flexible member, however, providing a secure connection with this arrangement requires only that the force required to attach or release the connection be greater than any perpendicular forces which may act upon the connector. Since, as noted above, the perpendicular forces exclude the tension forces applied by the ends of the flexible member, they essentially only include such forces as gravity acting upon one unsupported member, and different acceleration forces applied to the two ends of the flexible member. Since jewelry uses small connectors with little weight, which do not experience acceleration forces, these perpendicular forces are quite small. Consequently the predetermined perpendicular force required to connect or disconnect the connector, while still providing a secure connection, can also be made quite small.

The preferred embodiments of the invention all have a connector with only two parts, namely a receiver and an insert, which are connected to opposite ends of a flexible member. The receiver has at least one projection which forms an enclosure sized to enclose at least a portion of the insert. The enclosure has an opening oriented essentially perpendicular to the orientation of the connected flexible member's opposed ends under tension. The opening and the enclosed portion of the insert are sized and arranged such that a predetermined force is required to pass the enclosed portion of the insert through the opening. This required predetermined force can be obtained by having a flexible opening, sized to restrict the passage of the insert, or by having a rigid restricted opening and a compressible insert. This required force can also be obtained by having both a restricted opening with a flexible opening and a compressible insert.

The parts are connected by forcing the insert through the opening into the enclosure. A guide extending outwardly from the opening centers the insert on the opening to aid in connecting the parts. To disconnect the parts, since tension on the flexible member ends cannot pull the insert through the opening, the insert must be pulled outward by hand in a direction perpendicular to the orientation of connected flexible members under tension.

In one embodiment the insert is essentially spherical, the enclosure is hollow and hemispherical, and the opening is essentially circular.

In another embodiment, the insert is cylindrical, the enclosure is essentially one-half of the cross-section of a hollow cylinder, and the opening is essentially rectangular. With this arrangement the insert and receiver must be aligned along their cylindrical axis for the insert to enter the opening.

In yet another embodiment, the insert and receiver are both essentially planar and disk shaped, with an enclosure defining a planar disk shaped volume parallel to the receiver planar surface, and an opening which is essentially perpendicular to the receiver planar surface. With this arrangement the insert and receiver must be aligned along both planar axes in order for the insert to be contained by the enclosure. In this embodiment, when one of the receiver's planar sides is placed upon an essentially horizontal surface, the receiver will remain in that attitude with the opening either upward or downward. This stability permits using only one hand to connect and disconnect the connector, as will be described later in detail.

The operations for connecting or disconnecting the insert and receiver require only that one part be forced a small distance into or out of the other part. This simple operation, the fact that the force required can be made quite small, and the centering guide makes connecting and disconnecting the parts quite easy.

BRIEF DESCRIPTION OF THE DRAWINGS

The objects and features of the present invention will become more manifest to those skilled in the art upon a reading of the following descriptions, taken in connection with the accompanying drawings and wherein.

DETAILED DESCRIPTION OF THE INVENTION

Figure 1A:
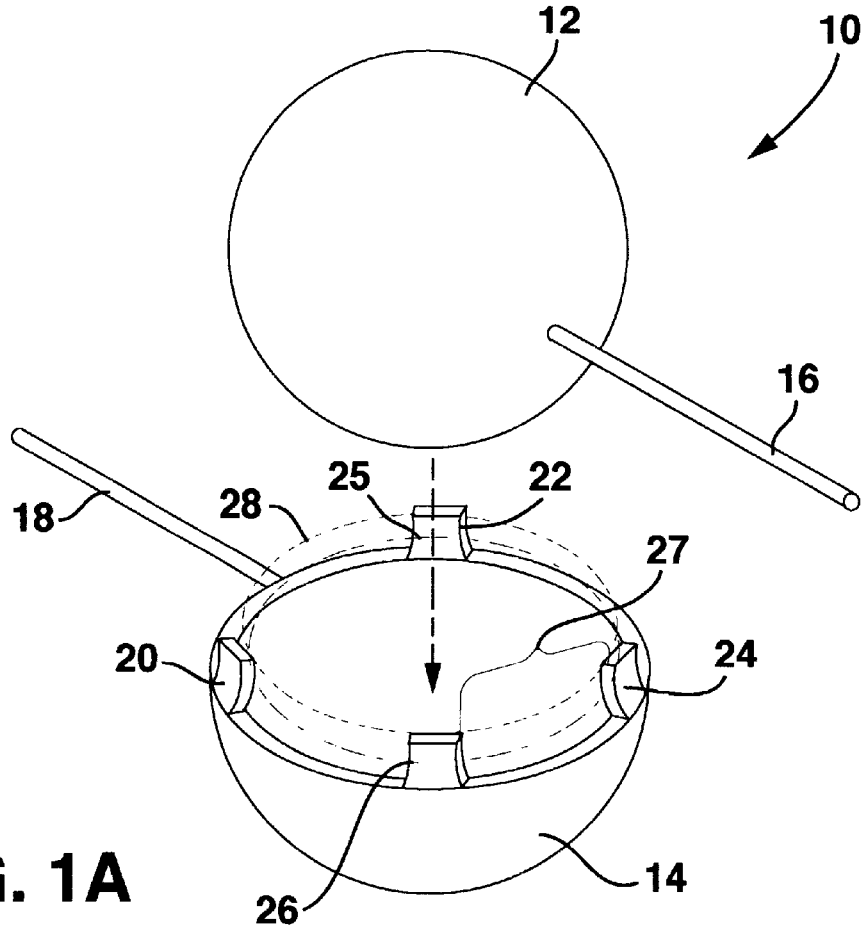
FIG. 1A is an isometric view of a first version of the first embodiment of the connector before attachment showing a spherically shaped insert and a hemispherically shaped hollow receiver having flexible projections forming an enclosure and opening.

FIG. 1A shows a first version of a first embodiment of the connector. Here connector 10 consists of a spherically shaped insert 12 and a hollow mating hemispherely shaped receiver 14. Insert 12 is attached to one end 16 of a flexible member and receiver 14 is attached to the opposite end 18 of the same flexible member. Receiver 14 has four attached flexible projections 20, 22, 24 and 26. All of the projections 20, 22, 24 and 26 have the same identical shape, first curving inwardly to form a restricted opening 25 smaller than the diameter of insert 12, then outwardly such that their ends beyond the opening form a guide 28 larger than the opening. The axis of opening 25 is parallel to the direction of the arrow. An enclosure 29 is formed by the inner surfaces of receiver 14 and the inner surfaces of the portions of projections 20, 22, 24 and 26 which are located within opening 25.

Figure 1B:
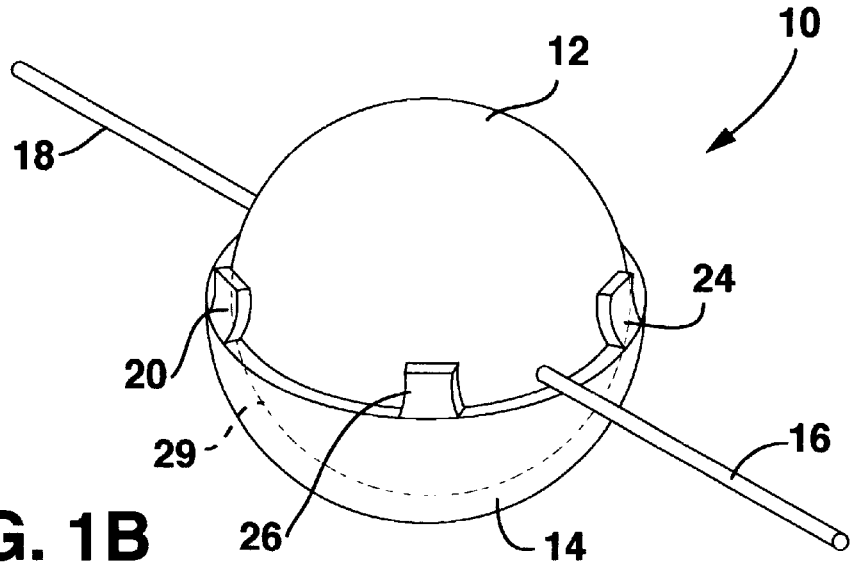
FIG. 1B is an isometric view of the first version of the first embodiment of the connector after attachment.

To connect the parts, insert 12 is positioned above receiver 14, as shown in FIG. 1A, with end 16 generally opposite space 27 between projections 24 and 26, and the insert is then placed against guide 28 to center the insert on opening 25. Insert 12 is then forced past opening 25 in the direction indicated by the arrow into enclosure 29, which completes the connection as shown in FIG. 1B. The amount of force required to move insert 12 through opening 25 in either direction is determined by the flexibility of projections 20, 22, 24 and 26, and the amount opening 25 is restricted relative to insert 12.

When connected, as shown in FIG. 1B, opposed tension force on flexible member ends 16 and 18 will pull insert 12 against the inner surface of enclosure 29 adjacent to end 16, and against the inner surface of projections 24 and 26 located within opening 25. The axis of opening 25 is oriented perpendicular to the direction assumed by flexible member ends 16 and 18 under tension. This results in the tension forces directed along flexible member ends 16 and 18 always being perpendicular to opening 25, consequently the insert cannot be removed from enclosure 29 by tension forces on the flexible member ends regardless of their magnitude.

To disconnect insert 12 from receiver 14, the insert is pulled outwardly using flexible member end 16 through opening 25 in the direction opposite to that of the arrow shown in FIG. 1A. Since this direction of force cannot be generated by opposed tension on the flexible member ends 16 and 18 themselves, insert 12 must be pulled out by hand.

Figure 1C:
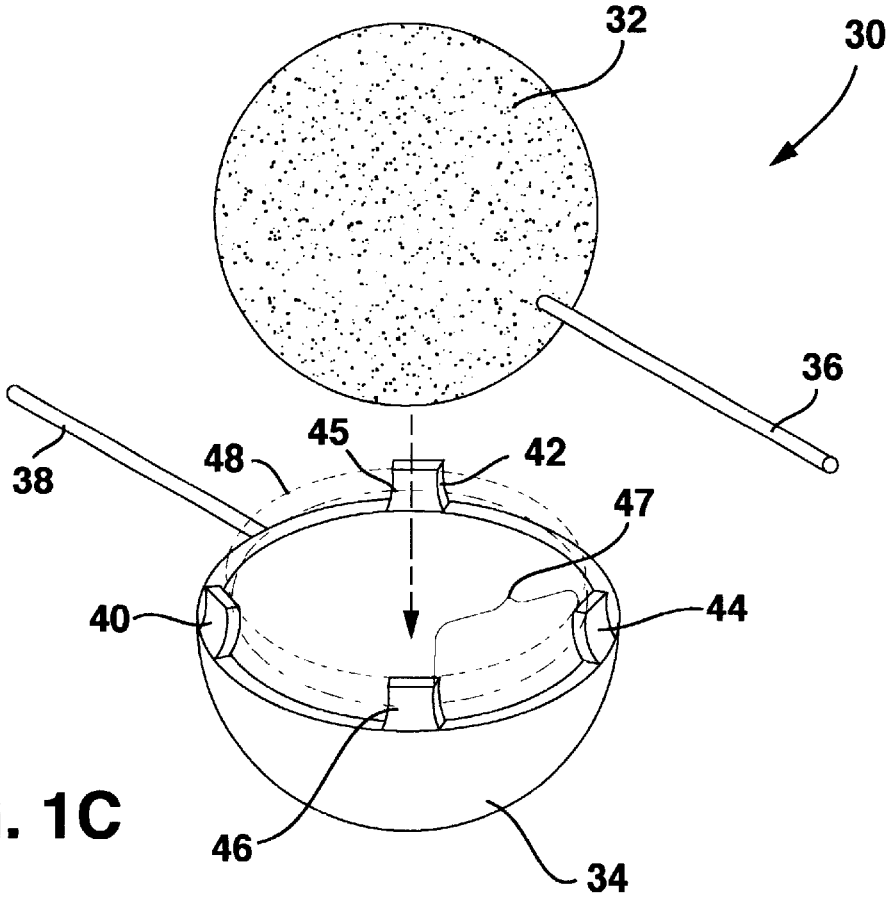
FIG. 1C is an isometric view of a second version of the first embodiment of the connector before attachment showing a compressible spherically shaped insert and a hemispherically shaped hollow receiver having rigid projections forming an enclosure and opening.

In FIG. 1C a second version of the first embodiment of the connector is shown. Here connector 30 has the same parts with the same shape and operates in substantially the same manner as connector 10. However, here the spherically shaped insert 32 attached to flexible member end 36 is made of compressible sponge rubber material, and the hollow hemispherically shaped receiver 34 attached to flexible member end 38 has rigid attached projections 40, 42, 44 and 46, having however the same shape as projections 20, 22, 24 and 26. With this shape, projections 40, 42, 44 and 46 form a restricted opening 45 smaller than the diameter of insert 32, and a guide 48 larger than the receiver opening. The axis of opening 45 is parallel with the direction of the arrow. The inner surfaces of receiver 34 and the inner surfaces of projections 40, 42, 44 and 46 located within opening 45 form an enclosure 49.

Figure 1D:
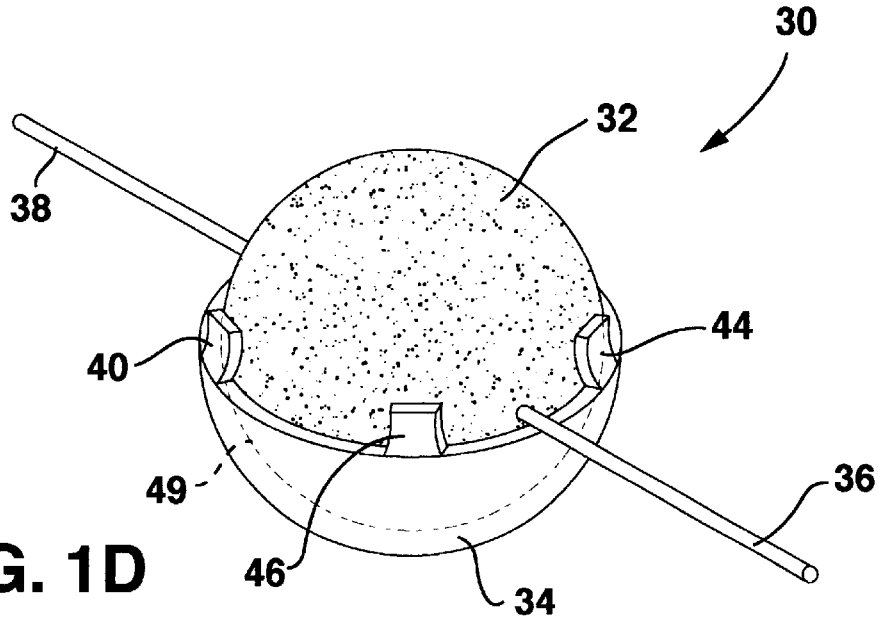
FIG. 1D is an isometric view of the second version of the first embodiment of the connector after attachment.

Again, to connect the parts, insert 32 is positioned above receiver 34, as shown in FIG. 1C, with end 36 generally opposite space 47 between projections 44 and 46, and the insert is then placed against guide 48 to center the insert on opening 45. Insert 32 is then forced past opening 45 in the direction indicated by the arrow into enclosure 49, which completes the connection as shown in FIG. 1D.

Under tension flexible member end 36 attached to insert 32 extends outwardly in a orientation directly opposite to end 38 attached to receiver 34, and the axis of the opening 45 is oriented essentially perpendicular to the orientation of the flexible member's ends under tension.

The only differences between connector 30 and 10 are that here projections 40, 42, 44 and 46 are rigid where projections 20, 22, 24 and 26 were flexible, and insert 32 is compressible where insert 12 was not. Because of these differences, the amount of force required to move insert 32 through opening 45 in either direction is now determined by the compressibility of insert 32 and the amount opening 45 is restricted. Otherwise, the connection illustrated in FIG. 1D, the connection and disconnection process, and the resulting connection provided by connector 30 is identical to that of connector 10.

Figure 2A:
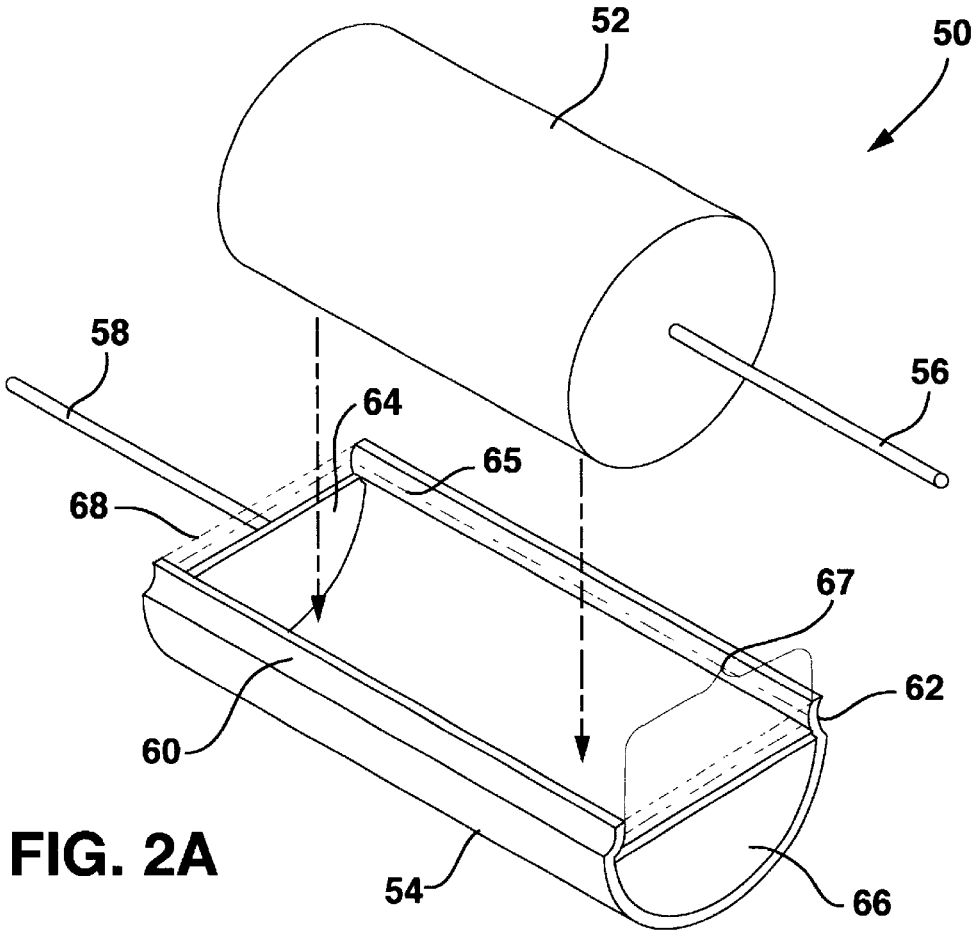
FIG. 2A is an isometric view of the second embodiment of the connector before attachment showing a cylindrically shaped insert and a hollow receiver shaped like one half of a hollow cylinder, taken across the cross-section, with the receiver having flexible projections forming two sides of an enclosure and opening.

FIG. 2A shows a second embodiment of the connector. Here connector 50 consists of an essentially cylindrically shaped insert 52 and a mating receiver 54 consisting of essentially one half of a hollow cylindrical shape taken across its cross-section. Insert 52 is attached to one end 56 of a flexible member and receiver 54 is attached to the opposite end 58 of the same flexible member. Receiver 54 has two attached flexible projections 60, and 62 along the parallel edges of the open half cylinder which define the two major sides of rectangular shaped opening 65. Projections 60 and 62 curve inwardly to form a space between the sides of restricted opening 65, which is smaller than the diameter of the cylinder shape of insert 52, the projections then curve outward to form two sides of a guide 68 which are spaced further apart than the same diameter.

Receiver 54 has opposed ends 64 and 66 which extend outward to the inner edge of projections 60 and 62 which form the two minor sides of guide 68. An enclosure 69 is formed by the inner surfaces of receiver 54, the inner surfaces of projections 60 and 62 within opening 65, and receiver ends 64 and 66.

Figure 2B:
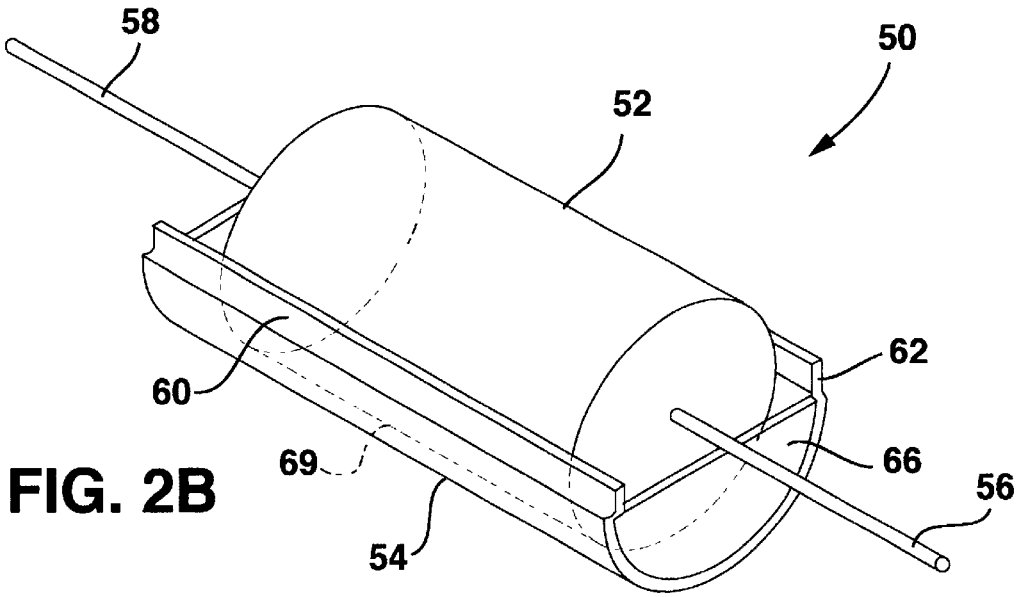
FIG. 2B is an isometric view of the second embodiment of the connector after attachment.

To connect the parts, insert 52 is positioned above receiver 54 with ends 56 and 58 opposing each other, as shown in FIG. 2A, then the insert is placed against sides 60 and 62 of guide 68 to align the insert with opening 65. After insert 52 is positioned opposite opening 65, it is then forced past opening 65 in the direction indicated by the arrows into enclosure 69, which completes the connection as shown in FIG. 2B. The amount of force required to move insert 52 through opening 65 in either direction is determined by the stiffness of projections 60, 62, and the amount opening 65 is restricted.

When connected, as shown in FIG. 2B, opposed tension force on flexible member ends 56 and 58 will pull insert 52 against the inner surface of receiver end 66. To make the alignment step prior to connection easier, insert 52 is made shorter than the space between receiver ends 64 and 66. An insert 52 shorter than the space between receiver ends 64 and 66 will still be restrained within enclosure 69 by projections 60 and 62. Insert 52 will merely translate within enclosure 69 toward end 66 when tension is applied to flexible member end 56, which will have no effect on the connection integrity. Opposed tension on flexible member ends 56 and 58 will cause them to extend outwardly from each other in a predetermined orientation. The axis of opening 65 is oriented essentially perpendicular to the orientation of the flexible member ends under tension. Receiver projections 60 and 62 hold insert 52 within enclosure 69 abutting receiver end 66, therefore the insert cannot be removed from the enclosure by a tension force regardless of its magnitude.

To disconnect insert 52 from receiver 54, the insert is pulled outwardly by hand through opening 65 in the direction opposite to that of the arrows shown in FIG. 2A.

Figure 3A:
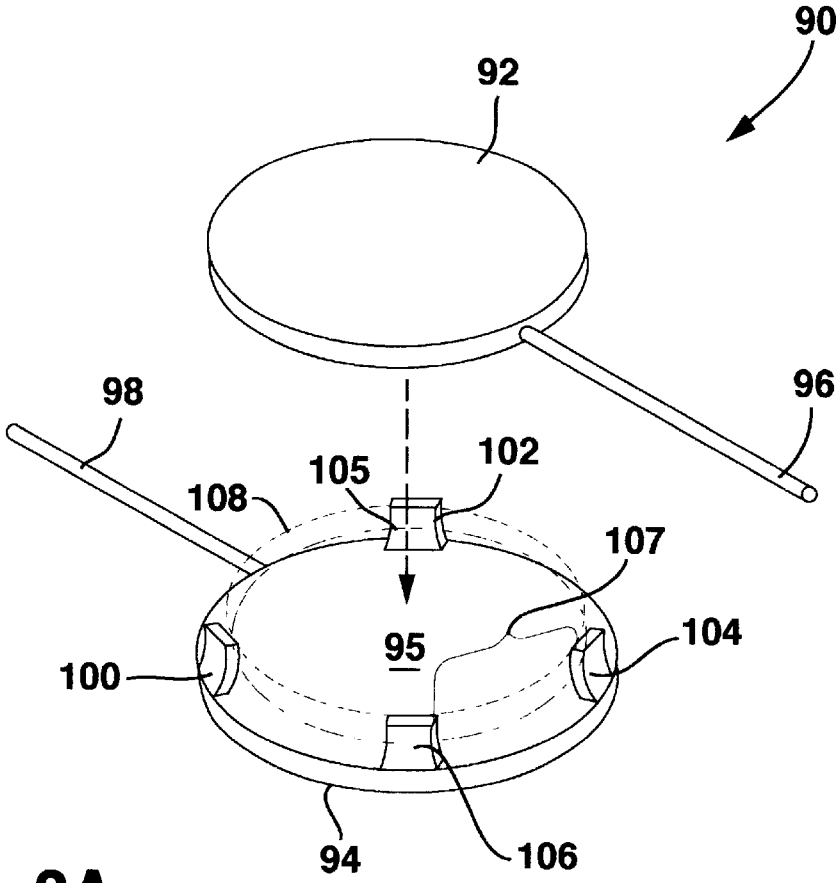
FIG. 3A is an isometric view of the third embodiment of the connector before attachment showing a disk shaped insert and a disk shaped receiver, with the receiver having flexible projections forming an enclosure and opening.

FIG. 3A shows a third embodiment of the connector. Here connector 90 consists of a disk shaped insert 92 and a disk shaped receiver 94. Insert 92 is attached to one end 96 of a flexible member 96 and receiver 94 is attached to the opposite end 98 of the same flexible member. Receiver 94 has a disk shaped base 95, which is slightly larger than insert 92, with the base having four equally spaced and essentially perpendicular flexible projections 100, 102, 104 and 106 attached to one surface around its periphery. All of the projections 100, 102, 104 and 106 have the same identical shape, first curving inwardly identically to form a restricted circular opening 105 smaller than diameter of the disk shape of insert 92, then outwardly to provide a guide 108 larger than the opening. The axis of opening 105 is parallel to the direction of the arrow.

A disk shaped enclosure 109 is formed by the inner surface of base 95 and the inner surfaces of the portions of projections 100, 102, 104 and 106 within opening 105.

Figure 3B:
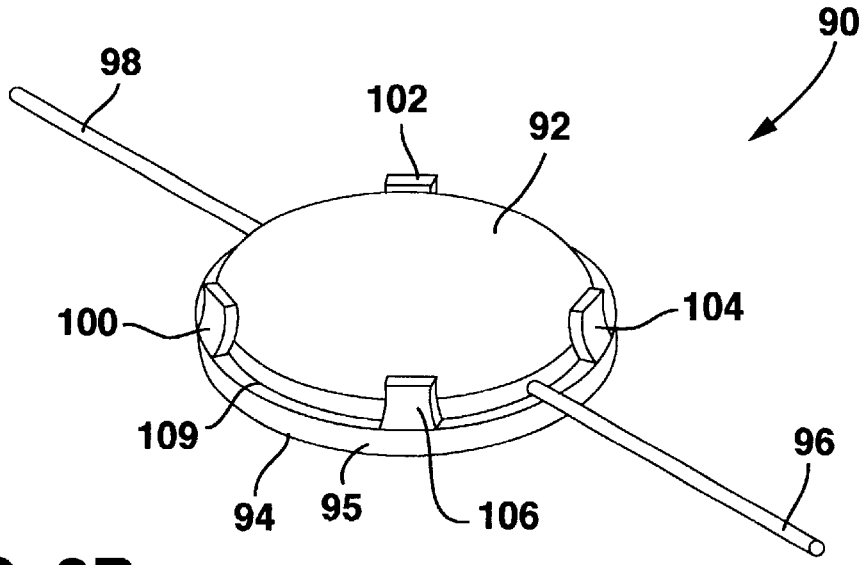
FIG. 3B is an isometric view of the third embodiment of the connector after attachment.

To connect the parts, insert 92 is positioned above receiver 94, as shown in FIG. 3A, with end 96 extending outwardly opposite space 107 between projections 104 and 106, and the insert is then placed against guide 108 to center the insert on opening 105. Insert 92 is then forced past opening 105 in the direction indicated by the arrow into enclosure 109, which completes the connection as shown in FIG. 3B. The amount of force required to move insert 102 through opening 105 in either direction is determined by the stiffness of projections 100, 102, 104 and 106, and the amount opening 105 is restricted with respect to insert 92.

When connected, as shown in FIG. 3B, opposed tension force on flexible member ends 96 and 98 will pull insert 92 against the inner surface of enclosure 109, and against the portions of projections 104 and 106 within opening 105. Opposed tension on flexible member ends 96 and 98 cause them to extend directly outwardly from each other. The axis of opening 105 is essentially perpendicular to the orientation of the flexible members under tension. Again, since the tension forces directed along flexible member ends 96 and 98 are always perpendicular to opening 105, the insert cannot be removed from enclosure 109 by tension forces on the flexible member ends regardless of their magnitude. To disconnect insert 92 from receiver 94, the insert is pulled outwardly through opening 105 by hand in the direction opposite to that of the arrow shown in FIG. 3A.

Since receiver 94 is planar the connection/disconnection process for connector 90 described above can be accomplished using only one hand. Since this is particularly useful when connecting and disconnecting a bracelet, this is the example used. A bracelet with attached connector 90 is extended upon an essentially horizontal surface, and the wrist placed over the approximate center of the bracelet. The free hand is then used for the following steps. Receiver 94 is placed uppermost on the wrist with opening 105 facing outward. The essentially horizontally supported wrist ensures that connector 90 will remain with opening 105 facing outward. Insert 92 is then placed against guide 108 with end 96 opposite space 107, and the insert is then either pressed or pinched into enclosure 109 through opening 105 in the direction shown by the arrow of FIG. 3A. This will result in the connection shown in FIG. 3B. To disconnect connector 90, receiver 94 is first reoriented such that opening 105 faces inward, then receiver 94 is pulled away from insert 92 against the restraint of flexible member end 96.

The above described embodiments do not exhaust all the possibilities of possible embodiments. In the embodiments shown, metal or plastic are both candidates for material used for the parts. Plastic material would probably be most applicable for inexpensive custom jewelry to provide both the flexible projections and the compressible insert. Because of their ease of connection, a sphere, cylinder and disk are shown here as the preferred shapes for the insert, however, any shapes will suffice which require a force to pass a portion of the insert through the opening into the enclosure. Further, while the enclosures and inserts here are essentially the same size and mate with each other, this is not an absolute requirement. Mating the insert and receiver to each other results in the minimum connector size, which is desirable for jewelry connectors. The insert could be made smaller than the receiver. A size differential between the insert and receiver, however, would produce no particular advantage to offset the resulting size disadvantage. Also, providing a space in the projections to receive the end attached to the insert is not an absolute requirement either. If this space were not provided, in the embodiments shown the end attached to the insert under tension would merely be inclined slightly outward an amount equal to the length of the projection. Since the projections are short, this would result in the receiver opening being only slightly less than perpendicular with respect to the ends under tension. Making the insert much smaller than the receiver would increase the length of the projections and the resulting inclination of the angle. Even here however, the force required to remove the insert from the enclosure would have the major component perpendicular to the direction assumed by the flexible member ends under tension, and would not compromise the connection integrity. Further, as noted above, a large differential in size between the insert and receiver is not desirable because it is counter-productive.

The above are just a few examples of the modifications and changes that are possible, and would readily occur to one skilled in the art, therefore it is contemplated that the appended claims will cover any such modifications or embodiments as fall within the true scope of the invention.

What is claimed is:

1. Connector apparatus for jewelry comprising:

a. a flexible member having a first end and a second end;

b. a first part comprising an insert attached to the first end of the flexible member;

c. a second part comprising a receiver attached to the second end of the flexible member;

d. connection means for connecting the first and second part, arranged such that the first part is connected to and disconnected from the second part only by a predetermined force, which is essentially perpendicular to the orientation of the connected flexible member ends under tension, applied between the parts, where one direction of the predetermined force connects the parts, and the opposite direction of the predetermined force disconnects the parts, wherein said connection means comprises the receiver having at least one projection arranged to form an enclosure which is sized and arranged to enclose at least a portion of the insert, the enclosure having an opening, with the opening and the insert being sized and arranged such that at least said portion of said insert can pass through the opening but only when said predetermined force, having an orientation essentially perpendicular to the orientation of the connected flexible member ends under tension, is applied between the insert and the receiver opening, and with the axis of the opening being essentially perpendicular to the orientation of the connected flexible member ends under tension; wherein the insert is essentially spherical in shape, the enclosure is essentially the shape of a hollow hemisphere and the opening is essentially circular in shape.

2. Apparatus as in claim 1 wherein the enclosure opening is formed by a plurality of flexible projections.

3. Apparatus as in claim 2 wherein the projections each have an outwardly extending guide at its terminus.

4. Apparatus as in claim 1 wherein the opening comprises a plurality of rigid projections and a compressible insert.

5. Apparatus as in claim 4 wherein the projections each have an outwardly extending guide at its terminus.

6. Connector apparatus for jewelry comprising:

a. a flexible member having a first end and a second end;

b. a first part comprising an insert attached to the first end of the flexible member;

c. a second part comprising a receiver attached to the second end of the flexible member;

d. connection means for connecting the first and second part, arranged such that the first part is connected to and disconnected from the second part only by a predetermined force, which is essentially perpendicular to the orientation of the connected flexible member ends under tension, applied between the parts, where one direction of the predetermined force connects the parts, and the opposite direction of the predetermined force disconnects the parts, wherein said connection means comprises the receiver having at least one projection arranged to form an enclosure which is sized and arranged to enclose at least a portion of the insert, the enclosure having an opening, with the opening and the insert being sized and arranged such that at least said portion of said insert can pass through the opening but only when said predetermined force, having an orientation essentially perpendicular to the orientation of the connected flexible member ends under tension, is applied between the insert and the receiver opening, and with the axis of the opening being essentially perpendicular to the orientation of the connected flexible member ends under tension; and wherein the insert, the enclosure and the opening are all elongated along an axis aligned with the direction the flexible members assume under tension, such that the enclosed portion of the insert can pass through the opening and the enclosure can enclose a portion of the insert only when the elongated axis are aligned with one another; and wherein the insert is essentially cylindrical in shape, the receiver is essentially the shape of a hollow one half of a cylinder taken across the cross-section, and the opening is essentially rectangular in shape.

7. Apparatus as in claim 6 wherein the enclosure opening comprises a pair of flexible projections along the major axis of the rectangular opening.

8. Apparatus as in claim 7 wherein said projections each have an outwardly extending guide at its terminus.

9. Connector apparatus for jewelry comprising:

a. a flexible member having a first end and a second end;

b. a first part comprising an insert attached to the first end of the flexible member;

c. a second part comprising a receiver attached to the second end of the flexible member;

d. connection means for connecting the first and second part, arranged such that the first part is connected to and disconnected from the second part only by a predetermined force, which is essentially perpendicular to the orientation of the connected flexible member ends under tension, applied between the parts, where one direction of the predetermined force connects the parts, and the opposite direction of the predetermined force disconnects the parts, wherein said connection means comprises the receiver having at least one projection arranged to form an enclosure which is sized and arranged to enclose at least a portion of the insert, the enclosure having an opening, with the opening and the insert being sized and arranged such that at least said portion of said insert can pass through the opening but only when said predetermined force, having an orientation essentially perpendicular to the orientation of the connected flexible member ends under tension, is applied between the insert and the receiver opening, and with the axis of the opening being essentially perpendicular to the orientation of the connected flexible member ends under tension; and wherein the insert and receiver are essentially planar, and the enclosure encloses a planar shaped space which is essentially parallel to the plane of the receiver arranged such that the insert can be enclosed only when the insert and receiver planes are essentially disk shaped; wherein the enclosure opening comprises a plurality of flexible projections; and wherein the flexible projections each have an outwardly extending guide at its terminus.

* * * * *